US010022976B2

(12) United States Patent
Turkenitz et al.

(10) Patent No.: US 10,022,976 B2
(45) Date of Patent: Jul. 17, 2018

(54) CONTROLLING AN INK FLOW TO A PRINT HEAD

(71) Applicant: HEWLETT-PACKARD DEVELOPMENT COMPANY, L.P., Houston, TX (US)

(72) Inventors: Chen Turkenitz, Ramat Hasharon (IL); Semion Gengrinovich, Ramat Gan (IL); Moti Balaish, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/029,732

(22) PCT Filed: Oct. 22, 2013

(86) PCT No.: PCT/US2013/066147
§ 371 (c)(1),
(2) Date: Apr. 15, 2016

(87) PCT Pub. No.: WO2015/060828
PCT Pub. Date: Apr. 30, 2015

(65) Prior Publication Data

US 2016/0250860 A1 Sep. 1, 2016

(51) Int. Cl.
*B41J 2/175* (2006.01)
*B41J 2/165* (2006.01)

(52) U.S. Cl.
CPC ..... *B41J 2/17596* (2013.01); *B41J 2/175* (2013.01); *B41J 2/17566* (2013.01); *B41J 2002/16594* (2013.01)

(58) Field of Classification Search
CPC .... B41J 2/17596; B41J 2/17566; B41J 2/175; B41J 2002/16594
See application file for complete search history.

(56) References Cited

U.S. PATENT DOCUMENTS 4,252,296 A * 2/1981 Berg ..... F01L 9/04 137/269
4,602,662 A 7/1986 Eremity et al.
4,785,314 A 11/1988 Terasawa et al.
5,027,857 A * 7/1991 Champseix ..... F16K 7/16 137/625.44
5,199,462 A * 4/1993 Baker ..... F16K 11/022 137/625.44
5,535,777 A * 7/1996 Maracchi ..... F16K 17/164 137/456
5,650,811 A * 7/1997 Seccombe ..... B41J 2/175 347/85

(Continued)

FOREIGN PATENT DOCUMENTS

JP 2001071536 3/2001
JP 2007261161 10/2007

(Continued)

OTHER PUBLICATIONS

PCT Search Report/Written Opinion—Application No. PCT/US2013/066147 dated Jun. 26, 2014~14 pages.

*Primary Examiner* — Julian Huffman
(74) *Attorney, Agent, or Firm* — Fabian VanCott

(57) ABSTRACT

Controlling an ink flow to a print head includes using a diaphragm positioned within a pathway to obstruct the ink flow.

20 Claims, 4 Drawing Sheets

(56) References Cited

U.S. PATENT DOCUMENTS 5,653,422 A * 8/1997 Pieloth ..... F16K 31/0682 137/596.17
5,736,992 A * 4/1998 Pawlowski, Jr. ..... B41J 2/175 347/7
5,980,028 A * 11/1999 Seccombe ..... B41J 2/17513 347/85
6,209,997 B1 4/2001 Duong et al.
6,325,354 B1 * 12/2001 Hoen ..... B41J 2/17513 251/129.17
6,908,180 B2 6/2005 Dietl
7,568,793 B2 * 8/2009 Lewey ..... B41J 2/175 347/85
7,845,781 B2 12/2010 Silverbrook et al.
8,366,231 B2 2/2013 Karn et al.
8,480,216 B2 7/2013 Matsumoto et al.
8,500,258 B2 8/2013 Esdaile-Watts et al.
9,315,040 B2 * 4/2016 Inoue ..... B41J 2/17596
2002/0024543 A1 * 2/2002 Kimura ..... B41J 2/17509 347/7
2003/0202057 A1 * 10/2003 Childs ..... B41J 2/175 347/85
2004/0215406 A1 * 10/2004 Hoen ..... F16K 31/082 702/50
2006/0038862 A1 * 2/2006 Tanno ..... B41J 2/17596 347/84
2007/0206050 A1 * 9/2007 Morgan ..... B41J 2/14 347/42
2009/0015618 A1 * 1/2009 Jung ..... B41J 2/175 347/17
2009/0153629 A1 6/2009 Yokouchi et al.
2010/0245465 A1 * 9/2010 Nakamura ..... B41J 2/1652 347/30
2012/0194620 A1 * 8/2012 Matsumoto ..... B41J 2/16523 347/85
2013/0222491 A1 8/2013 Nanjo et al.

FOREIGN PATENT DOCUMENTS

JP 2009-166359 7/2009
JP 2009166473 7/2009
JP 2011110863 6/2011
JP 2012166509 9/2012
JP 2013144413 7/2013

* cited by examiner

CONTROLLING AN INK FLOW TO A PRINT HEAD

BACKGROUND

In the large format printing industry, often print heads are situated on a beam array that positions the print heads over a printing medium. Multiple mechanisms can be used to create sufficient pressure to deliver ink to the print heads. One such example includes using gravity to create such pressure.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

In some types of printers, the beam array holds secondary tanks of ink that are lower than the print heads. When maintenance is performed on such printers, such as replacing or cleaning the print heads, the beam array is often tilted up. Unfortunately, tilting up the beam array up can cause the ink in the print heads to flow out which wastes ink. To prevent from wasting ink, the principles described herein include a diaphragm control unit that is positioned within a pathway between the secondary ink tank or tanks and the print heads. The diaphragm control unit can obstruct the ink flow when activated, thereby preventing ink from flowing out of the printer when a user performs maintenance on the printer.

However, the diaphragm control unit provides more advantages than merely controlling the ink flow. The diaphragm control unit is sized to be more compact than traditional control valves in other ink flow pathways. Therefore, the ink pathway is enabled to be shorter than traditional ink flow paths. Also the diaphragm flow path allows the hydraulic diameter to remain unchanged. Therefore, a pressure drop created by the diaphragm control unit is either minimized or eliminated altogether. In other words, the geometry of the diaphragm control box maintains a hydraulic pressure between a first channel of the pathway and a second channel of the pathway. The principles described herein can also provide other advantages to printers.

The principles described herein include an apparatus for controlling an ink flow to a print head. Such an apparatus can include a pathway between an ink reservoir and a print head and a diaphragm control unit being positioned to obstruct and open a flow within the pathway.

The principles described herein include an apparatus for controlling an ink flow to a print head. Such a method may include applying an external air pressure to a back side of a diaphragm inserted into a cover of an ink reservoir.

The principles described herein include a printer for controlling an ink flow to a print head. Such a printer may include a pathway between an ink reservoir and a print head, a diaphragm control unit being positioned to obstruct a flow between a first channel of the pathway and a second channel of the pathway, and a sensor that determines a position of the diaphragm.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
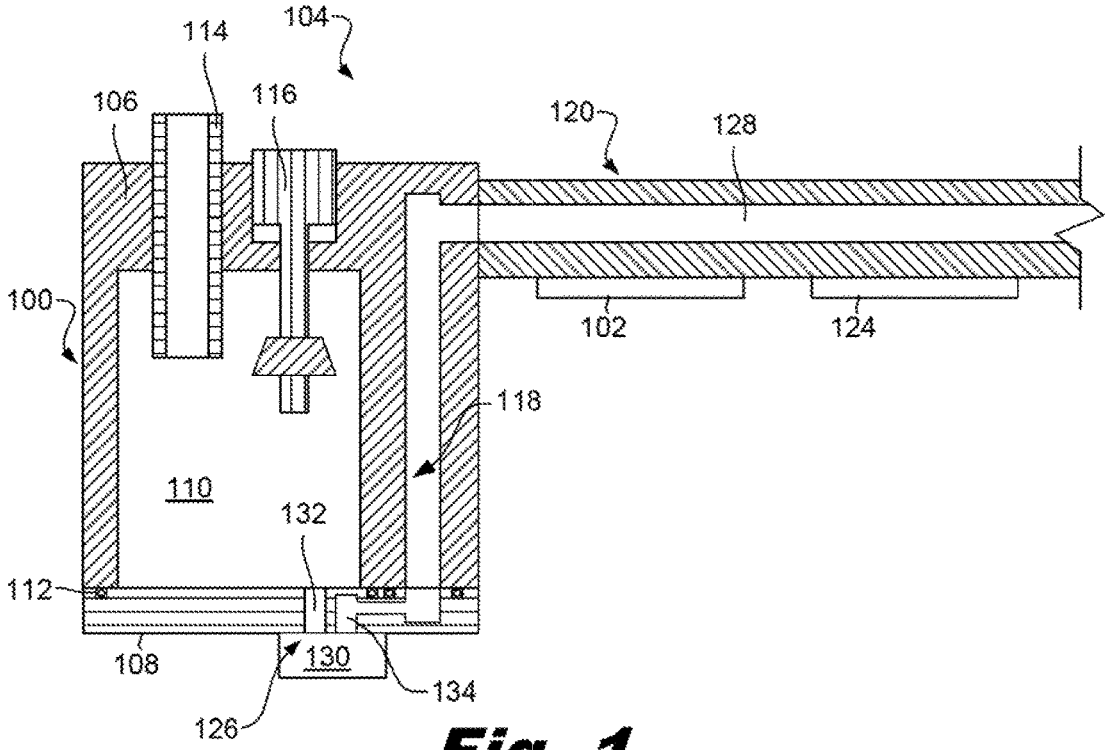
FIG. 1 is a diagram of an example of an apparatus that controls an ink flow from a reservoir to a print head according to the principles described herein.

FIG. 1 is a diagram of an example of an apparatus (100) that controls an ink flow from a reservoir (100) to a print head (102) according to the principles described herein. In this example, the apparatus is a printer (104). Any appropriate type of printer may be used. For example, the printer (104) may be a large format printer. The printer may be used to print magazines, periodicals, newspapers, posters, documents, two dimensional printed materials, three dimensional printed objects, or combinations thereof. The printers may use any appropriate type of printing medium, such as paper, plastics, optical media, cardstock, translucent media, other types of media, or combinations thereof.

The ink reservoir (100) may be formed collectively by a housing (106) and a covering (108). A cavity (110) may be formed in the housing (106) which may provide the space for the ink to occupy. The covering (108) may be attached to the housing (106) in any appropriate manner. In some examples, the covering (108) and the housing (106) are attached through compression fits, thread fittings, fasteners, adhesives, other forms of attachment, or combinations thereof. O-rings or other types of seals (112) may be placed at various positions between the interface where the covering (108) and the housing (106) contact. Such seals (112) may stop ink from leaking between the covering (108) and the housing (106). While this example has been described with specific reference to the ink reservoir (100) being formed with a housing (106) and a covering (108), in other examples, the ink reservoir (100) is formed out of a single unitary component. In yet other examples, additional components are used to form the ink reservoir.

The ink may enter the ink reservoir (100) through an input port (114). Any appropriate type of input port (114) may be used in accordance with the principles described herein. In some examples, the input port (114) is an open flow valve, another type of valve, a fitting, a nozzle, another type of input port, or combinations thereof. The ink may enter the ink reservoir (100) through the input port (114) from any appropriate type of ink source (not shown). The input port (114) may operate in conjunction with a float valve (116) or another type of level indicating mechanism. The float valve (116) may signal to the input port (114) that additional ink should be infused into the ink reservoir (100) in response to measuring that the ink level in the ink reservoir (100) has reached a predetermined level.

A pathway (118) may direct ink from the reservoir (100) to a print head array (120). On the underside of the print head array (120), print heads (102, 124) are positioned to deposit ink on printing media that passes under the print head array (120). The pathway (118) connects the ink from the reservoir (100) to the print heads (102, 124). In the example of FIG. 1, the outlet (126) from the ink reservoir (100) is lower than the manifold (128) of the pathway (118) in the print head array (120) that distributes the ink to the print heads (102, 124). As such, an active flow mechanism may be used to cause the ink to flow from the ink reservoir (100) to the manifold (128). In some examples, the positions of the ink reservoir (100) and the print heads (102, 124) are such that gravity is utilized to cause the ink to flow to the print heads (102, 124). While this example has been described with reference to just two print heads (102, 124), any appropriate number of print heads may be incorporated into the print head array (120).

In the example of FIG. 1, the ink pathway (118) is formed in three distinct components, the covering (108), the housing (106), and the print head array (120). Portions or the entire pathway (118) may be formed with gun drilled holes. In other examples, the pathway (118) is formed at the time that the distinct components are formed such as through molding, casting, forging, other types of processes, or combinations thereof. While the example of FIG. 1 depicts the ink pathway (118) as being formed in distinct components, in other examples, the ink pathway is formed in a single unitary component.

A diaphragm control unit (130) is connected to the covering (108) of the ink reservoir (100). The diaphragm control unit (130) may be a diaphragm valve, a diaphragm pump, another mechanism that uses a diaphragm, or combinations thereof. The diaphragm control unit (130) is positioned to connect a first channel (132) of the pathway (118) and a second channel (134) of the pathway (118). The diaphragm control unit (130) may have an open position to allow ink to pass from the first channel (132) to the second channel (134). Further, the diaphragm control unit (130) may have a closed position to prevent ink from passing from the first channel (132) to the second channel (134). By preventing ink from passing from the first channel (132) to the second channel (134), the ink is also prevented from reaching the print heads. Thus, it may be desirable to close the diaphragm control unit (130) when the printer (104) is not performing an operation, is undergoing maintenance, is being cleaned, is having a part replaced, or experiencing another condition. In some examples, the diaphragm control unit (130) is opened just during those times when the printer (104) is performing a print job.

Figure 2:
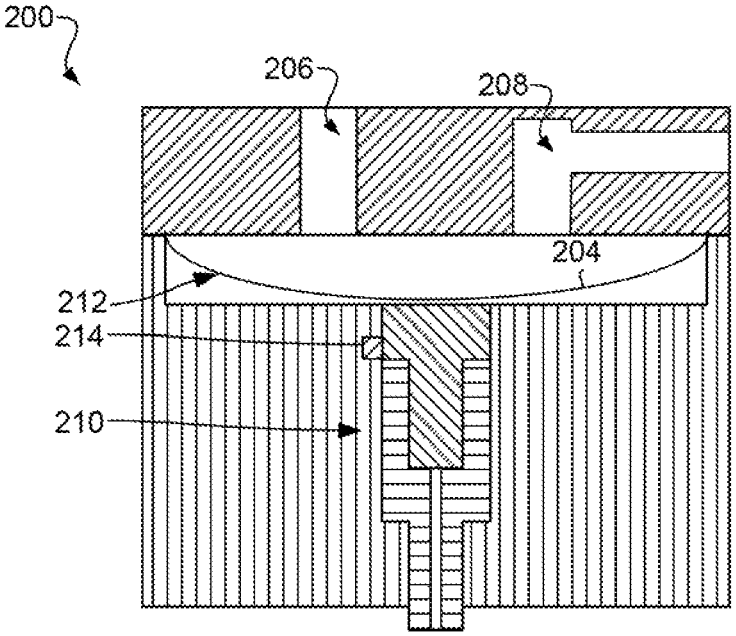
FIG. 2 is a diagram of an example of a diaphragm control unit in an open position according to the principles described herein.

FIG. 2 is a diagram of an example of a diaphragm control unit (200) in an open position according to the principles described herein. In this example, the diaphragm control unit (200) is a valve. The diaphragm control unit (200) has a diaphragm (204) that is positioned adjacent to the first channel (206) that communicates directly with the ink reservoir (100, FIG. 1) and the second channel (208) which directs ink towards the print heads. In the example of FIG. 2, both the first and second channels (206, 208) are formed in a covering (210) that at least partially forms the ink reservoir (100, FIG. 1).

The diaphragm (204) is positioned to be moved towards or away from the first and second channels (206, 208). The diaphragm (204) may be moved by an actuator (210) positioned on a back side (212) of the diaphragm (204). The actuator (210) may include any appropriate type of mechanism that is capable of moving the diaphragm (204). For example, the actuator (210) may be a liquid activated piston, an air activated, piston, a liquid pump, an air pump, a solenoid, another type, of mechanism, or combinations thereof. The diaphragm (204) may be made of any appropriate type of material that can be moved by the actuator (210). For example, the diaphragm (204) may be made of an elastomeric material, rubber, cloth, fabric, plastic, a compressible material, another type of material, or combinations thereof.

The actuator (210) may be actuated with any appropriate mechanism. In some cases, the actuator (210) is actuated remotely. Thus, a user can control the position of the diaphragm control unit (200) without having physical access to the diaphragm control unit (200). For example, the diaphragm control unit (200) can be beneath additional coverings or housings that are not visible to the user. However, the user can actuate the diaphragm control unit (200) by flipping a switch, pressing a button, or otherwise selecting a mechanism that sends a signal to the diaphragm control unit (200) with a command to switch the diaphragm's position. Such a signal may be carried over an electrically conductive medium, such as an electrically conducting cable. In other examples, a wireless signal may be used to communicate the selected position to the diaphragm control unit (200).

When the diaphragm control unit (200) is in an open position, the actuator (210) is in a retracted position. This allows the pressure from the ink reservoir to push against the front side of the diaphragm (204) with just the inherent resistance of the diaphragm's material resisting the ink's pressure. As a result, the diaphragm (204) moves back to allow the ink to flow freely. This allows the ink to freely pass from the first channel (206) to the second channel (208). One of the advantages of using a diaphragm control unit (200) positioned adjacent to the first and the second channels (206, 208) is that the hydraulic diameter of the first and second channels (206, 208) is minimally affected or not affected at all when the diaphragm control unit (200) is in an open position. Thus, there is a minimal pressure drop, if any, between the first channel (206) and the second channel (208) due to the presence to the diaphragm control unit (200).

Another advantage of the principles described herein is that the first and the second channel (206, 208) can be located close to each. Other types of control units may involve rerouting the ink pathway or extending the ink pathway to incorporate various components used in these other types of control units. Such longer pathways increase the size of the printer which causes more material to be used, more pressure to send the ink to the print heads, more risk for damage to the pathway, other drawbacks, or combinations thereof. Thus, the principles described herein can incorporate a shorter pathway between the ink reservoir and the print heads and improve the over quality of the printer.

In some examples, the ink exhibits a corrosive characteristic. As such, metal materials that come into contact with the ink may over time, lose their mechanical integrity. Other types of valves may include metal components that contact the ink. Such metal components of other types of valves may be used due to their good wear resistance abilities. However, with the principles described herein, just the diaphragm contacts the ink and isolates other moving parts from contacting the ink. Thus, the principles described herein allow moving parts to be made of materials that have desirable characteristics that may or may not be prone to ink-induced corrosion.

In the example of FIG. 2, the diaphragm control unit (200) includes a sensor (214) that can detect the position of the diaphragm (204). Any appropriate type of sensor may be used to determine the position of the diaphragm (204). For example, the sensor (214) may be used to detect an air pressure behind a moving part of the actuator (210), such as a pressure driven piston. In other examples, the sensor (214) may be a magnetic sensor that is positioned to sense a magnetic component of a movable member of the actuator (210), such as a pressure driven piston. In yet other examples, the sensor (214) is positioned to sense the pressure directly on the back side (212) of the diaphragm (204). In additional examples, the sensor (214) is positioned to directly detect the position of the diaphragm (204). The sensor (214) can provide feedback to a user as to whether the diaphragm control unit (200) is in an open or a closed position. If the sensor indicates that the diaphragm control unit is in an open position, the user will be aware that the user should change the diaphragm control unit's position before performing maintenance on the print heads or other parts of the printer. On the other hand, if the sensor indicates that the diaphragm control unit (200) is in a closed position, then the user is aware that the user can perform maintenance as desired.

Figure 3:
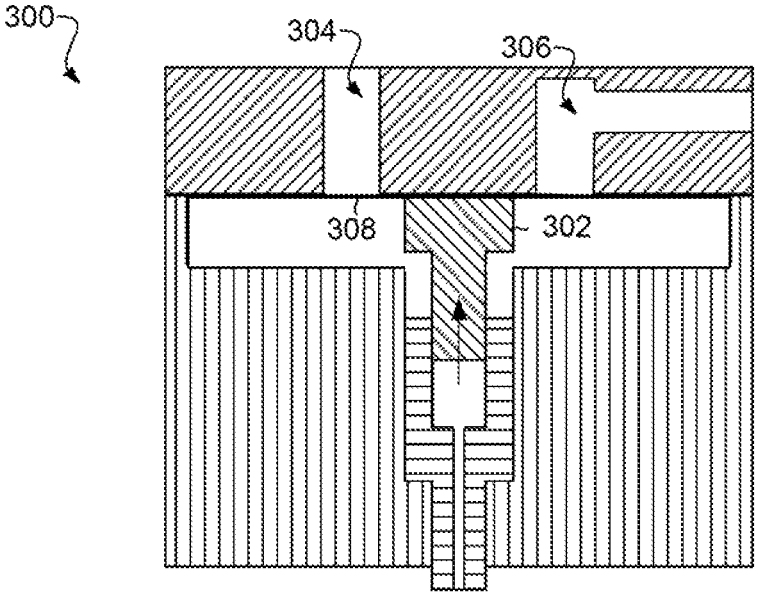
FIG. 3 is a diagram of an example of a diaphragm control unit in a closed position according to the principles described herein.

FIG. 3 is a diagram of an example of a diaphragm control unit (300) in a closed position according to the principles described herein. In this example, a pressure driven piston (302) is moved closer to an area between the first channel (304) and the second channel (306). The pressure driven piston (302) moves the diaphragm (308) with the piston (302) as the piston (302) advances. The piston (302) moves far enough to cause the diaphragm (308) to block the ink from passing from the first channel (304) to the second channel (306). In some examples, the piston (302) moves far enough to cause the diaphragm (308) to form a seal between the first channel (304) and the second channel (306).

The piston (302) may be moved forward due to an increased air pressure behind the piston (302). A pump, or another mechanism, may be used to increase the air pressure and cause the piston (302) to move. In some examples, an air pressure is increased directly behind the diaphragm (308) without a mechanical member pushing on the back side of the diaphragm (308).

While the above examples have been described with reference to just two positions, an open position and a closed position, the diaphragm control unit (300) may incorporate additional positions. For example, the diaphragm control unit (300) may incorporate a position that is between the open and closed positions. Further, while the examples above have been described with reference to specific geometries, materials, and activation mechanisms of the diaphragm control unit, any appropriate type of geometry, material, and activation mechanisms may be used in accordance with the principles described herein.

Figure 4:
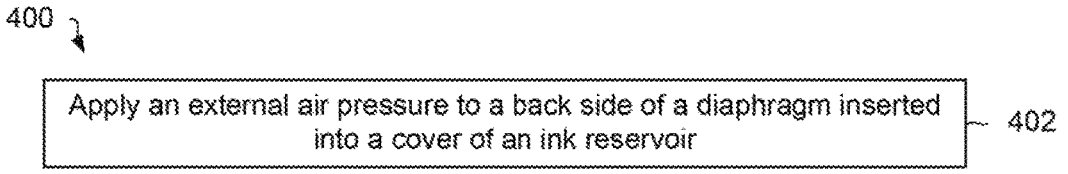
FIG. 4 is a diagram of an example of a method for controlling an ink flow to a print head according to the principles described herein.

FIG. 4 is a diagram of an example of a method (400) for controlling an ink flow to a print head according to the principles described herein. In this example, the method (400) includes applying (402) an external air pressure to a back side of a diaphragm inserted into a cover of an ink reservoir.

The external air pressure may be applied directly to the back side of the diaphragm or indirectly to the back side of the diaphragm such as with a pressure driven piston. Further, the diaphragm may be a diaphragm incorporated into a diaphragm control unit as described above.

Figure 5:
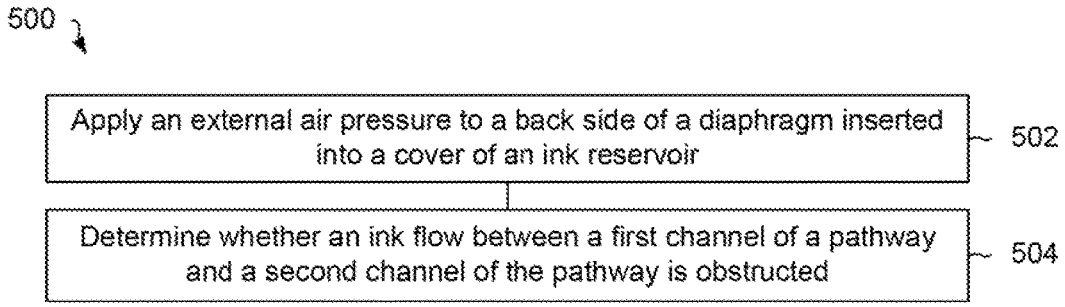
FIG. 5 is a diagram of an example of a method for controlling an ink flow to a print head according to the principles described herein.

FIG. 5 is a diagram of an example of a method (500) for controlling an ink flow to a print head according to the principles described herein. In this example, the method (500) includes applying (502) an external air pressure to a back side of a diaphragm inserted into a cover of an ink reservoir and determining (504) whether an ink flow between the first channel of a pathway and a second channel of the pathway is obstructed.

The external pressure applied to the back side of the diaphragm moves the diaphragm in such a way so as to prevent fluid communication between the first and second channels. Thus, a sensor can be used to sense the position of a mechanical member in contact with the diaphragm or to sense a pressure behind the diaphragm to determine whether the pathway between the first and second channels is obstructed. In some examples, a pressure within the first or the second channels may also be used to determine whether there is an obstruction between the first and the second channels. In some examples, there is a closed loop sensor incorporated into the diaphragm control unit which determines whether the pathway is obstructed.

Figure 6:
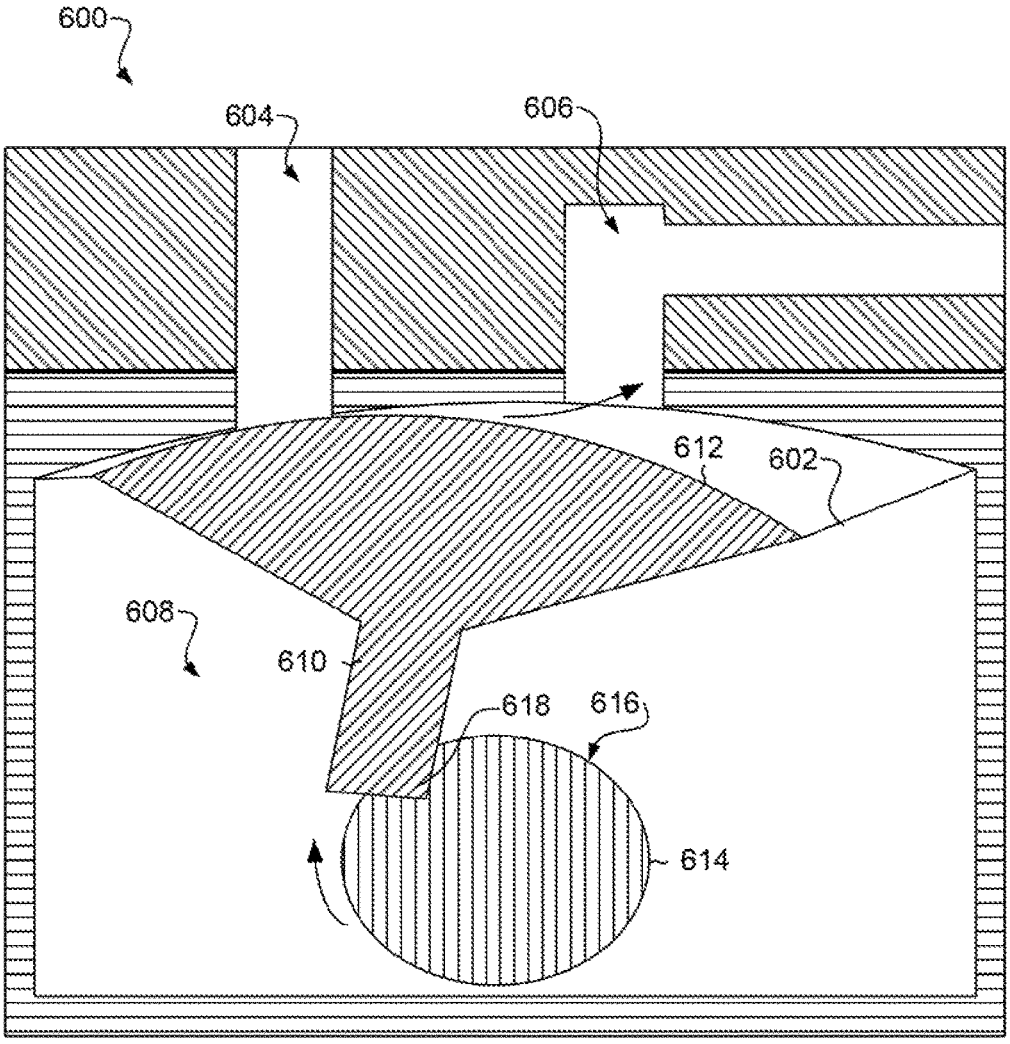
FIG. 6 is a diagram of an example of a diaphragm control unit according to the principles described herein.

FIG. 6 is a diagram of an example of a diaphragm control unit (600) according to the principles described herein. In this example, the diaphragm control unit (600) is a pump. The diaphragm control unit (600) has a diaphragm (602) that is positioned adjacent to the first channel (604) that communicates directly with the ink reservoir (100, FIG. 1) and the second channel (606) which directs ink towards the print heads.

The diaphragm (606) is positioned to be moved towards or away from the first and second channels (604, 606). The diaphragm (602) may be moved by an actuator (608) that is connected to the diaphragm (602). In this example, the actuator (608) includes a piston (610) that has a rounded surface (612). The piston (610) is also connected to a cam member (614) near the cam member's periphery (616). The cam member (614) is positioned to rotate, and a cam end (618) of the piston (610) follows the periphery as the cam member (614) rotates. As the cam end (618) moves as controlled by the cam member's rotation, the round surface's movement is limited because it is connected to the diaphragm (602). The combined forces caused by the movement of the cam member (614) and the restriction of that movement caused by the diaphragm (602) causes the rounded surface to move in such way that periodically opens and closes the first channel (604).

When the first channel (604) is blocked, no new ink enters into the diaphragm control unit (602). However, the rounded surface (612) is constantly moving when the cam is moving. Thus, the rounded surface (612) moves to another position. As the rounded surface (612) moves, the rounded surface (612) forces ink in the diaphragm control box (602) towards the second channel (606), which forces ink out of the diaphragm control box (602). In this manner, the diaphragm control box (602) can move ink from the first channel (604) to the second channel (606).

A sensor may also be used with the example of FIG. 6. In this manner, the sensor can determine whether the rounded surface (612) is in a position that blocks the ink from entering the diaphragm control box (602) by covering the first channel (604) or in a position that blocks ink from leaving the diaphragm control box (602) by blocking the second channel (606). In this example, the sensor may sense the rotational position of the cam member (14) to determine the position of the rounded surface (612). With such a sensor, the user can determine the position of the diaphragm control box (602) and determine whether the user can perform maintenance or perform other tasks with the printer without wasting ink.

While this example has been described with reference to specific geometries of a pump in a diaphragm control box (602), any appropriate type of pump may be used in accordance with the principles described herein. Further, while the examples have been described with reference to specific diaphragm valves and diaphragm pumps, any appropriate type of diaphragm valve or diaphragm pumps may be used in accordance with the principles described herein.

While the examples above have been described with reference to specific mechanisms for moving the diaphragm to either open or obstruct the pathway between the first and second channels, any appropriate mechanism for moving the diaphragm may be used in accordance with the principles described herein. Further, the geometry of the pathway between the first and the second channels may be any appropriate geometry. For example, the geometry may include a wider diameter than either of the first or second channels, a narrower diameter than either of the first or second channels, a protrusion to interface with the diaphragm, a recess to interface with the diaphragm, another type of geometry, or combinations thereof.

Any appropriate amount of pressure may be applied to the diaphragm. In some examples, the pressure is sufficient to create a seal such that no ink can pass from the first channel to the second channel. In other examples, the pressure is sufficient to block a majority of the ink from passing while allowing a little ink to pass.

The thickness of the diaphragm may be any appropriate thickness. The diaphragm may have a sufficient thickness such that some of the diaphragm's material can bulge into either the first or the second channels. Such bulging may aid in creating a seal. In some examples, the diaphragm has varying thicknesses. In such examples, the diaphragm's thickness may be larger in areas that are more prone to failure by fatigue.

The examples described above have been described with reference to a specific location for the diaphragm control unit, the diaphragm control unit may be positioned in any appropriate location along the pathway from the ink reservoir to the print heads. Thus, in some examples, the diaphragm control unit is adjacent the print heads, in the manifold, adjacent to the ink reservoir, in the covering, in the housing in the ink reservoir, in another appropriate location, or combinations thereof.

The preceding description has been presented only to illustrate and describe examples of the principles described. This description is not intended to be exhaustive or to limit these principles to any precise form disclosed. Many modifications, and variations are possible in light of the above teaching.

What is claimed is:

1. An apparatus for controlling an ink flow to a print head, comprising:

a pathway between an ink reservoir and a print head and partially formed in a cover of said ink reservoir at a bottom of the ink reservoir;

a flexible diaphragm positioned to selective move into and out of the portion of the pathway formed in the cover of said ink reservoir at the bottom of the ink reservoir; and a diaphragm control unit being positioned to selectively obstruct and open a flow between a first channel of said pathway and a second channel of said pathway using a diaphragm, wherein the diaphragm is sized and positioned to simultaneously cover and seal both an output of the first channel and a separate input of the second channel when the diaphragm is in a closed position under control of the diaphragm control unit.

2. The apparatus of claim 1, wherein said diaphragm control unit comprises a piston to selectively move the diaphragm.

3. The apparatus of claim 1, wherein said diaphragm control unit is a diaphragm pump.

4. The apparatus of claim 1, wherein said diaphragm is positioned to obstruct and open said flow within said pathway by being inserted into said cover of said ink reservoir.

5. The apparatus of claim 1, wherein said diaphragm control unit is positioned to open and close fluid communication between the first channel and the second channel.

6. The apparatus of claim 1, wherein said diaphragm control unit comprises a sensor that determines a location of the diaphragm.

7. The apparatus of claim 1, wherein said diaphragm control unit is actuatable from a remote location.

8. The apparatus of claim 1, wherein said diaphragm control unit is actuatable by applying external air pressure to a first side of the diaphragm.

9. The apparatus of claim 1, wherein said diaphragm control unit maintains a hydraulic pressure between a first channel of said pathway and a second channel of said pathway.

10. A method for operating the apparatus of claim 1 for controlling an ink flow to a print head, comprising:

applying an external air pressure to a back side of the diaphragm, wherein the diaphragm is inserted into the cover of the ink reservoir.

11. The method of claim 10, further comprising determining whether an ink flow between a first channel of said pathway and a second channel of said pathway is obstructed.

12. The apparatus of claim 1, wherein the diaphragm is of a thickness such that some of the diaphragm material bulges into the outlet from the ink reservoir to seal the outlet and prevent ink flow.

13. The apparatus of claim 1, wherein the diaphragm has a varying thickness along its length with an increased thickness in an area more prone to failure by fatigue than other areas of the diaphragm.

14. The apparatus of claim 1, wherein the diaphragm is made of a material resistant to ink-induced corrosion.

15. The apparatus of claim 1, wherein a hydraulic diameter of the pathway between the outlet of the reservoir and a separate inlet to the print head is unaffected when the diaphragm is in an open position.

16. A printer for controlling an ink flow to a print head, comprising:

a pathway between an ink reservoir and a print head;

an outlet of the ink reservoir to the pathway;

a flexible diaphragm positioned to selective move into and out of a portion of the pathway;

a diaphragm control unit being positioned to selectively obstruct a flow between a first channel of said pathway and a second channel of said pathway using the diaphragm, wherein the diaphragm is sized and positioned to simultaneously cover and seal both an output of the first channel and a separate input of the second channel when the diaphragm is in a closed position under control of the diaphragm control unit; and a sensor that determines a position of the diaphragm.

17. The printer of claim 16, wherein a diaphragm of said diaphragm control unit is inserted into a cover of said ink reservoir.

18. The printer of claim 16, wherein said diaphragm control unit maintains a hydraulic pressure between a first channel of said pathway and a second channel of said pathway.

19. The printer of claim 16, further comprising a float valve to control a flow of ink into the ink reservoir.

20. An apparatus for controlling an ink flow to a print head, comprising:

a pathway between an ink reservoir and a print head and partially formed in a cover of said ink reservoir at a bottom of the ink reservoir;

a flexible diaphragm positioned to selective move into and out of a portion of the pathway; and a diaphragm control unit being positioned to selectively obstruct and open a flow within said pathway, wherein the diaphragm control unit flexes the diaphragm against an outlet from the ink reservoir to prevent ink flowing under gravity from the ink reservoir and through the pathway to the print head;

wherein the diaphragm is sized and positioned to, in a closed position, simultaneously seal both an outlet from the ink reservoir and a separate inlet of the pathway to the print head.

* * * * *